US011719108B2

(12) United States Patent
Fujiwara et al.

(10) Patent No.: US 11,719,108 B2
(45) Date of Patent: Aug. 8, 2023

(54) TRANSITION PIECE, COMBUSTOR, AND GAS TURBINE ENGINE

(71) Applicant: MITSUBISHI HEAVY INDUSTRIES, LTD., Tokyo (JP)

(72) Inventors: Naoto Fujiwara, Yokohama (JP); Shohei Numata, Yokohama (JP); Yasuhiro Wada, Yokohama (JP); Shota Igarashi, Yokohama (JP); Yoshitaka Hirata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/946,456

(22) Filed: Sep. 16, 2022

(65) Prior Publication Data

US 2023/0094510 A1 Mar. 30, 2023

(30) Foreign Application Priority Data

Sep. 30, 2021 (JP) ..... 2021-161392

(51) Int. Cl.
*F01D 9/02* (2006.01)

(52) U.S. Cl.
CPC ..... *F01D 9/023* (2013.01); *F05D 2240/35* (2013.01); *F05D 2260/202* (2013.01);
(Continued)

(58) Field of Classification Search
CPC .. F01D 9/023; F23R 3/002; F23R 3/02; F23R 3/06; F23R 2900/03041; F23R 2900/03042; F23R 2900/03043
See application file for complete search history.

(56) References Cited

U.S. PATENT DOCUMENTS

2006/0130484 A1* 6/2006 Marcum ..... F01D 9/023 60/752
2010/0018211 A1 1/2010 Venkataraman et al.
(Continued)

FOREIGN PATENT DOCUMENTS

JP 2010-25543 A 2/2010
JP 2016-142613 A 8/2016
JP 2020-76551 A 5/2020

OTHER PUBLICATIONS

Office Action dated Apr. 27, 2023, issued in counterpart Japanese application No. 2021-161392, with English translation. (8 pages).

*Primary Examiner* — Scott J Walthour
(74) *Attorney, Agent, or Firm* — WHDA, LLP

(57) ABSTRACT

A transition piece includes a first flow passage group formed by arranging a plurality of intra-wall flow passages, a second flow passage group, and a plurality of dilution holes that penetrate a plate, and establish communication between a compressed air main flow passage and a combustion gas flow passage, each intra-wall flow passage of the first flow passage group and the second flow passage group having an inlet facing the compressed air main flow passage at an end portion on a side near the gas turbine, and having an outlet facing the combustion gas flow passage at an end portion on a side near the combustor liner, a dilution hole being located nearer to the inlet of an intra-wall flow passage of the second flow passage group than to the outlet of the intra-wall flow passage of the second flow passage group.

6 Claims, 8 Drawing Sheets

(52) U.S. Cl.
CPC .... *F05D 2260/232* (2013.01); *F05D 2260/60* (2013.01); *F05D 2260/941* (2013.01)

(56) References Cited

U.S. PATENT DOCUMENTS

| | | | | |
|---|---|---|---|---|
| 2010/0170260 | A1* | 7/2010 | Mawatari | F23R 3/06 60/755 |
| 2014/0290255 | A1* | 10/2014 | Akagi | F23R 3/06 60/752 |
| 2016/0047312 | A1* | 2/2016 | Hase | F23R 3/005 60/806 |
| 2018/0038594 | A1* | 2/2018 | Shibata | F23R 3/06 |
| 2019/0048799 | A1* | 2/2019 | Kishida | F23R 3/002 |
| 2021/0123351 | A1 | 4/2021 | Konishi et al. | |
| 2021/0302017 | A1 | 9/2021 | Tokuyama et al. | |

* cited by examiner

TRANSITION PIECE, COMBUSTOR, AND GAS TURBINE ENGINE

BACKGROUND OF THE INVENTION

1. Field of the Invention

The present invention relates to a transition piece, a combustor, and a gas turbine engine.

2. Description of the Related Art

A gas turbine engine combusts fuel in combustors together with a compressed air compressed by a compressor, and drives a gas turbine by a combustion gas thereby generated. The combustors are arranged plurally in the circumferential direction of a casing of the gas turbine engine. The combustion gas is supplied to the gas turbine via a transition piece formed in a tubular shape by a metallic plate in each combustor.

In the combustors, under a condition of a small amount of fuel, there is a case where an amount of supply of the compressed air to a burner becomes excessive, so that combustion temperature is decreased and combustion stability is decreased. There is a combustor in which air holes referred to as dilution holes are provided to the transition piece from a viewpoint of suppressing the decrease in the combustion stability (JP-2010-25543-A or the like). By making a part of the compressed air flow into a combustion gas flow passage on the inside of the transition piece via the dilution holes, it is possible to suppress the excessive supply of the compressed air to the burner while suppressing a decrease in the flow rate of an operating medium supplied to the gas turbine.

PRIOR ART DOCUMENT

Patent Document

[Patent Document 1]
JP-2010-25543-A

SUMMARY OF THE INVENTION

Flame temperature is lowered when air is supplied to a position where combustion reaction of a flame is not progressed sufficiently. Thus, the dilution holes of the transition piece are provided at a position where the combustion reaction of the flame is progressed sufficiently. However, a region in which the combustion reaction of the flame is sufficiently progressed is a harsh high-temperature environment. The transition piece, in particular, has a configuration in which the sectional shape of the transition piece changes gradually from an inlet formed in a circular shape according to the shape of a combustor liner to an outlet in a quadrangular shape. The transition piece thus has a large difference in curvature according to parts. Therefore, when the dilution holes are provided to the transition piece, stress in the vicinities of the dilution holes in the transition piece tends to be increased.

It is an object of the present invention to provide a transition piece, a combustor, and a gas turbine engine that can suppress stress in the vicinities of dilution holes.

In order to achieve the above object, according to the present invention, there is provided a transition piece disposed in a combustor that combusts fuel within a combustor liner together with a compressed air compressed by a compressor of a gas turbine engine, and supplies a combustion gas to a gas turbine, the transition piece connecting the combustor liner and the gas turbine to each other and being formed in a tubular shape by a plate, and the transition piece separating a compressed air main flow passage on an outside, the compressed air main flow passage being configured to supply the compressed air from the compressor to the combustor, from a combustion gas flow passage on an inside, the combustion gas flow passage being configured to supply the combustion gas from the combustor liner to the gas turbine, the transition piece including: a first flow passage group formed by arranging a plurality of intra-wall flow passages in a circumferential direction of the transition piece, the intra-wall flow passages extending within the plate from a side near the gas turbine to a side near the combustor liner; a second flow passage group located on a side near the combustor liner with respect to the first flow passage group, and formed by arranging a plurality of intra-wall flow passages in the circumferential direction of the transition piece, the intra-wall flow passages extending within the plate from a side near the gas turbine to a side near the combustor liner; and a plurality of dilution holes that penetrate the plate, and establish communication between the compressed air main flow passage and the combustion gas flow passage, each of the intra-wall flow passages of the first flow passage group and the second flow passage group having an inlet facing the compressed air main flow passage at an end portion on a side near the gas turbine, and having an outlet facing the combustion gas flow passage at an end portion on a side near the combustor liner, a dilution hole being located nearer to the inlet of an intra-wall flow passage of the second flow passage group than to the outlet of the intra-wall flow passage of the second flow passage group in each of spaces between the intra-wall flow passages adjacent to each other in the second flow passage group.

According to the present invention, it is possible to suppress stress in the vicinities of the dilution holes of the transition piece.

DESCRIPTION OF THE PREFERRED EMBODIMENTS

An embodiment of the present invention will hereinafter be described with reference to the drawings.

—Gas Turbine Engine—

Figure 1:
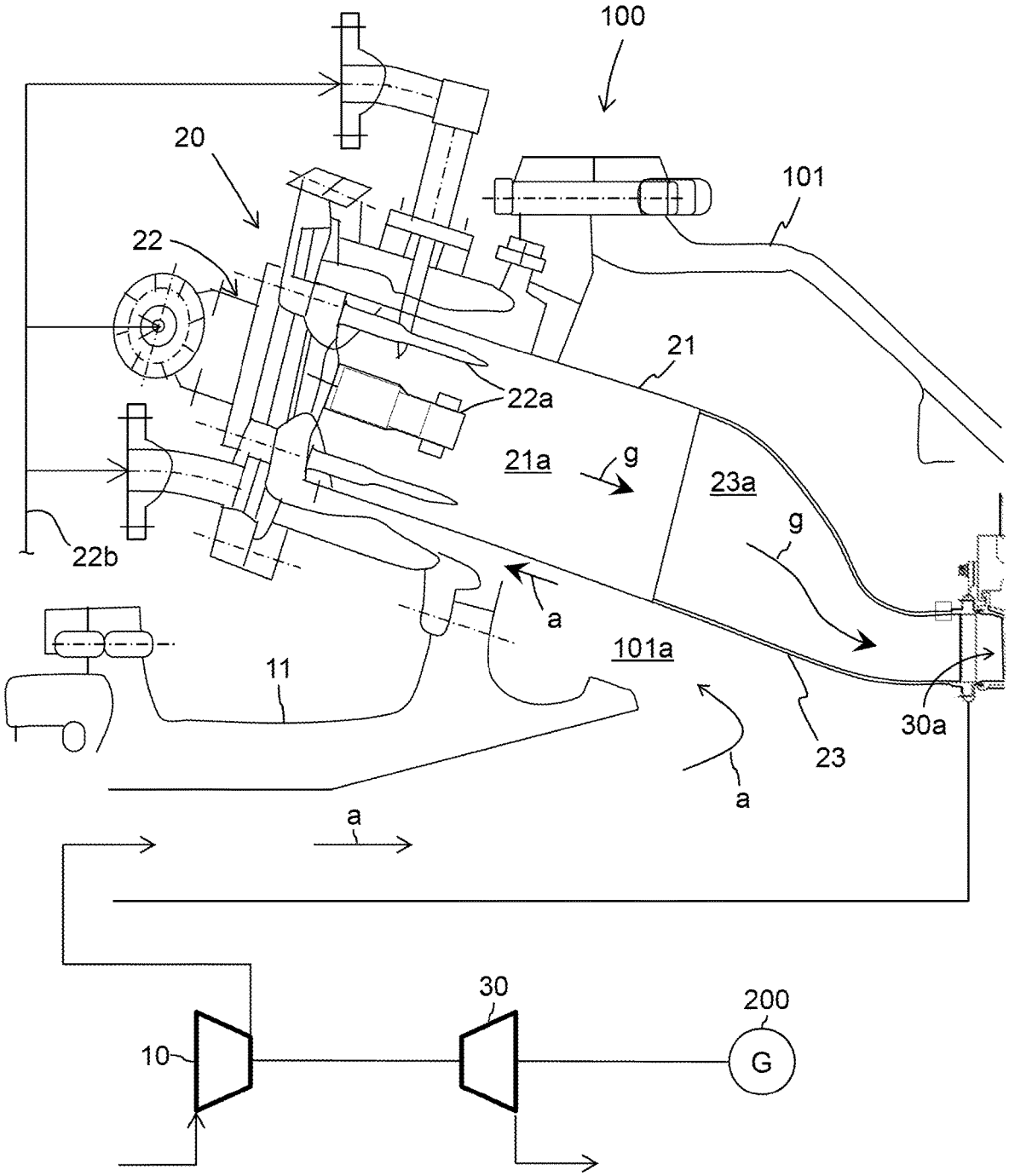
FIG. 1 is a schematic configuration diagram schematically illustrating an example of a gas turbine plant including a transition piece according to one embodiment of the present invention.

FIG. 1 is a schematic configuration diagram schematically illustrating an example of a gas turbine plant including a transition piece according to one embodiment of the present invention. The gas turbine plant shown in the figure includes a gas turbine engine 100 and a load apparatus 200 driven by the gas turbine engine 100. A typical example of the load apparatus 200 is a generator. However, there are also cases where a pump or a compressor (different from a compressor 10 provided to the gas turbine engine 100) is used as the load apparatus 200 in place of the generator, and the compressor or the pump is driven by the gas turbine engine 100.

The gas turbine engine 100 is a prime mover that drives the load apparatus 200. The gas turbine engine 100 includes a compressor 10, a combustor 20, and a gas turbine 30. The compressor 10 is configured to suck in and compress air, and generate a compressed air a at a high temperature and a high pressure. The combustor 20 is configured to generate a combustion gas g by combusting fuel together with the compressed air a delivered from the compressor 10 via a diffuser 11. The gas turbine 30 is driven by the combustion gas g supplied from the combustor 20, and outputs a rotational power. Shafts of rotors of the gas turbine 30 and the compressor 10 are connected to each other. A part of the output power of the gas turbine 30 is used as power of the compressor 10, and the rest is used as power of the load apparatus 200. The combustion gas g that has driven the gas turbine 30 is discharged as an exhaust gas via an exhaust chamber (not shown).

The present embodiment illustrates a case where the gas turbine engine 100 is of a single shaft type. However, the gas turbine engine 100 may be of a two-shaft type. In a case where a gas turbine engine of a two-shaft type is adopted, the gas turbine 30 is constituted by a high pressure turbine and a low-pressure turbine whose rotary shafts are separated from each other, the high pressure turbine is coaxially connected to the compressor 10, and the low-pressure turbine is coaxially connected to the load apparatus 200.

—Combustor—

A plurality of combustors 20 are attached to a casing 101 of the gas turbine engine 100 in the rotational direction of the gas turbine 30 (FIG. 1 shows only one combustor 20 as a representative). Each combustor 20 includes a combustor liner 21, a burner 22, and a transition piece 23. This combustor 20 generates the combustion gas g by combusting fuel jetted from the burner 22 within the combustor liner 21 (combustion chamber 21*a*) together with the compressed air a compressed by the compressor 10, and supplies the combustion gas g to the gas turbine 30 via the transition piece 23.

The combustor liner 21 is a cylindrical member that forms the combustion chamber 21*a* on the inside. The combustor liner 21 is installed within the casing 101. The combustor liner 21 separates the compressed air a introduced from the compressor 10 to the inside of the casing 101 (in other words, a compressed air main flow passage 101*a* on the outside of the combustor liner 21) from the combustion gas g generated in the combustion chamber 21*a* (in other words, the combustion chamber 21*a* on the inside of the combustor liner 21). An end portion on a gas turbine side (right side in the figure) of the combustor liner 21 is inserted in the transition piece 23.

The burner 22 is a device that jets the fuel into the combustion chamber 21*a* via at least one fuel nozzle 22*a*, and forms and maintains a flame within the combustion chamber 21*a*. The fuel from a fuel source (for example a fuel tank) is supplied to the fuel nozzle 22*a* via a fuel system (fuel piping) 22*b*.

A configuration of the transition piece 23 will next be described.

—Transition Piece—

Figure 2:
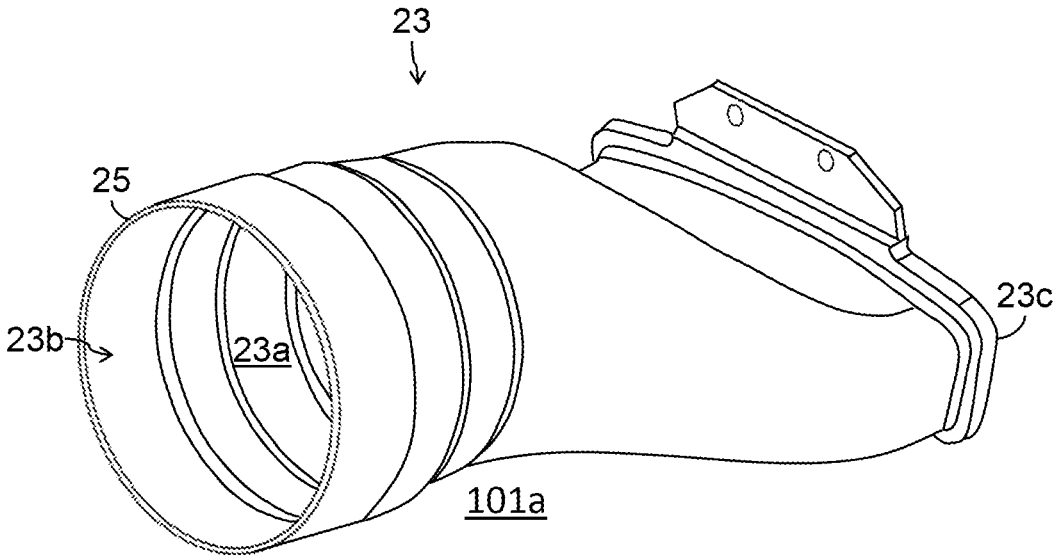
FIG. 2 is a perspective view of the transition piece according to one embodiment of the present invention.
Figure 3:
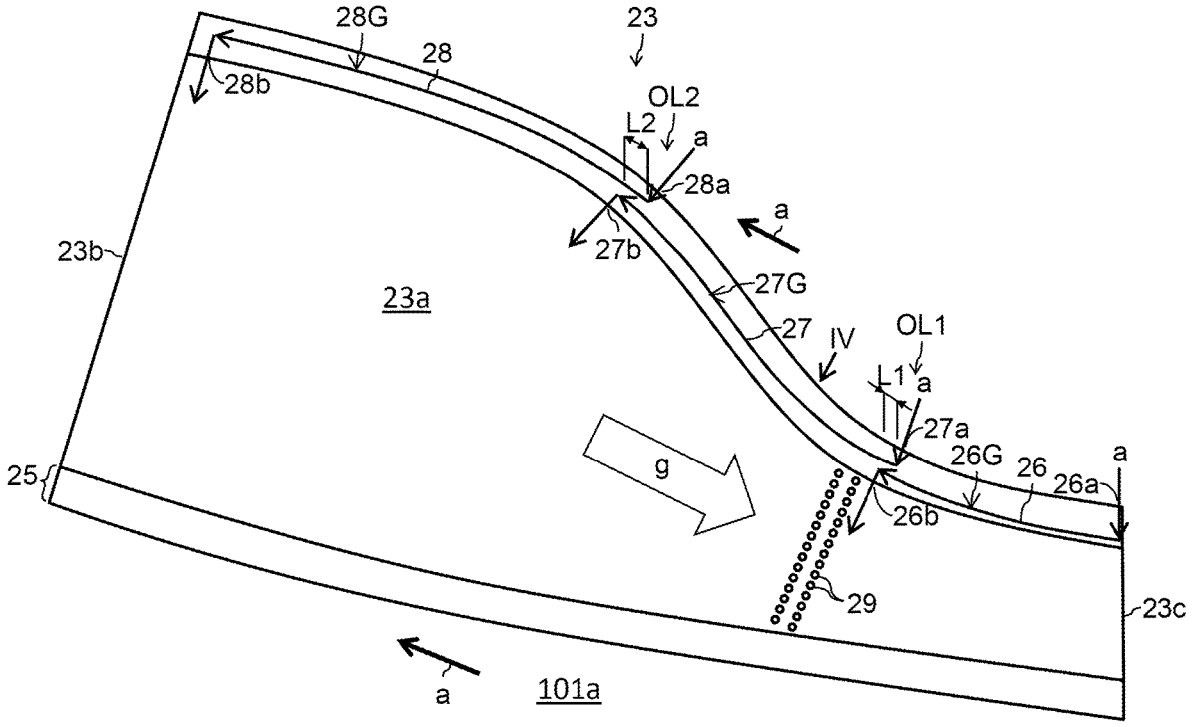
FIG. 3 is a schematic diagram of a section of the transition piece according to one embodiment of the present invention, the transition piece being sectioned by a plane passing through the center line of a gas turbine.

FIG. 2 is a perspective view of the transition piece. FIG. 3 is a schematic diagram of a section of the transition piece sectioned by a plane passing through the center line of the gas turbine 30. However, FIG. 2 does not show intra-wall flow passages 26 to 28 to be described later and dilution holes 29 (to be described later).

The transition piece 23 is a member that introduces the combustion gas g generated in the combustion chamber 21*a* into the gas turbine 30. The transition piece 23 connects the combustor liner 21 and the gas turbine 30 to each other, and is formed in a tubular shape by a plate (transition piece panel) 25 made of a metal (made of an alloy). This transition piece 23 separates the compressed air main flow passage 101*a* on the outside through which the compressed air a supplied from the compressor 10 to the burner 22 of the combustor 20 flows from a combustion gas flow passage 23*a* on the inside through which the combustion gas g supplied from the combustor liner 21 to the gas turbine 30 flows. As mentioned earlier, the combustor liner 21 is inserted into an end portion on a combustor liner side of the transition piece 23, that is, an inlet 23*b* of the combustion gas g. An end portion on a gas turbine side of the transition piece 23, that is, an outlet 23*c* of the combustion gas g faces an inlet 30*a* of the gas turbine 30 (FIG. 1). The combustion gas g is supplied from the outlet 23*c* of the transition piece 23 to an annular operating fluid flow passage that stator blades (not shown) and rotor blades (not shown) in the gas turbine 30 face.

The inlet 23*b* of the transition piece 23 is formed in a circular shape as shown in FIG. 2 so as to correspond to the outlet shape of the combustor liner 21 (FIG. 1) in a cylindrical shape. On the other hand, the outlet 23*c* of the transition piece 23 is formed in a quadrangular shape so as to correspond to a shape obtained by equally dividing the inlet 30*a* of the annular operating fluid flow passage of the gas turbine 30 into the number of the combustors 20 in the rotational direction of the gas turbine 30. The outlets 23*c* of the respective transition pieces 23 of the plurality of combustors 20 provided to the gas turbine engine 100 are connected to each other in the rotational direction of the gas turbine 30 to form an annular shape corresponding to the shape of the inlet 30*a* of the gas turbine 30. Therefore, the transition piece 23 is gradually changed in sectional shape from the circular inlet 23*b* to the quadrangular outlet 23*c*, and the curvature of the plate 25 constituting the transition piece 23 differs according to parts.

Figure 8:
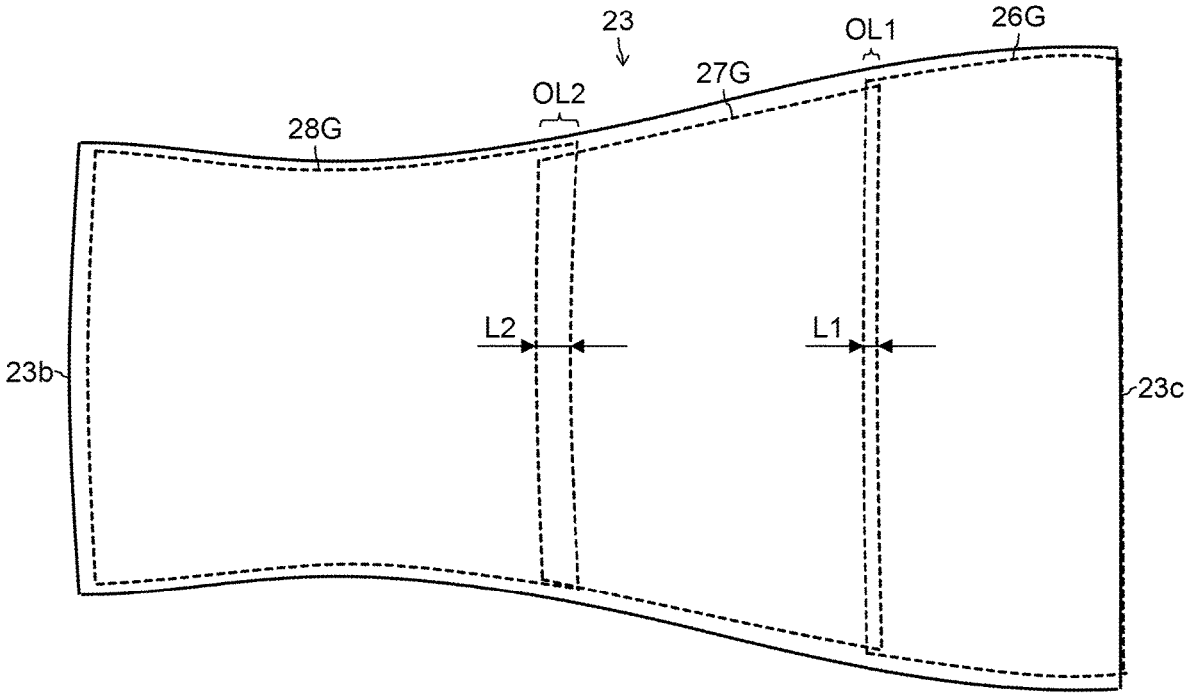
FIG. 8 is a schematic diagram showing installation regions of intra-wall flow passages in a back side portion of the transition piece according to one embodiment of the present invention.

For example, when the transition piece 23 is viewed from a back side, the width of the transition piece 23 (dimension in the rotational direction of the gas turbine 30) is changed from the inlet 23*b* toward the outlet 23*c*, and the width of the outlet 23*c* is widened with respect to the width of the inlet 23*b* (FIG. 8). On the other hand, when the transition piece 23 is viewed from a side, the width of the transition piece 23 (dimension in the radial direction of the gas turbine 30) is narrowed from the inlet 23*b* toward the outlet 23*c* (FIG. 3). The curvature of the plate 25 constituting the transition piece 23 thus differs according to a position in the flow direction of the combustion gas g and further a position in the circumferential direction of the transition piece 23. The shape of the transition piece 23 is smooth because of a role of introducing the combustion gas g, but is thus complex.

Incidentally, the back side of the transition piece 23 is an outside of the transition piece 23 in the radial direction of the gas turbine 30. Hence, an inside of the transition piece 23 in the radial direction of the gas turbine 30 is a belly side of the transition piece 23. In addition, viewing the transition piece 23 from a side means viewing the transition piece 23 from a direction along the rotational direction of the gas turbine 30.

In the present embodiment, each transition piece 23 is provided with a plurality of intra-wall flow passages 26 to 28 and a plurality of dilution holes 29, as shown in FIG. 3. Incidentally, with regard to the plurality of dilution holes 29, while the example shown in the figure illustrates a structure in which two annular columns having the dilution holes formed therein are arranged in the circumferential direction of the transition piece 23, the number of the columns may be one or three or more. An appropriate number of columns is selected from a viewpoint of combustion stability. The intra-wall flow passages 26 to 28 and the dilution holes 29 will be described in order in the following.

—Intra-Wall Flow Passages—

Figure 4:
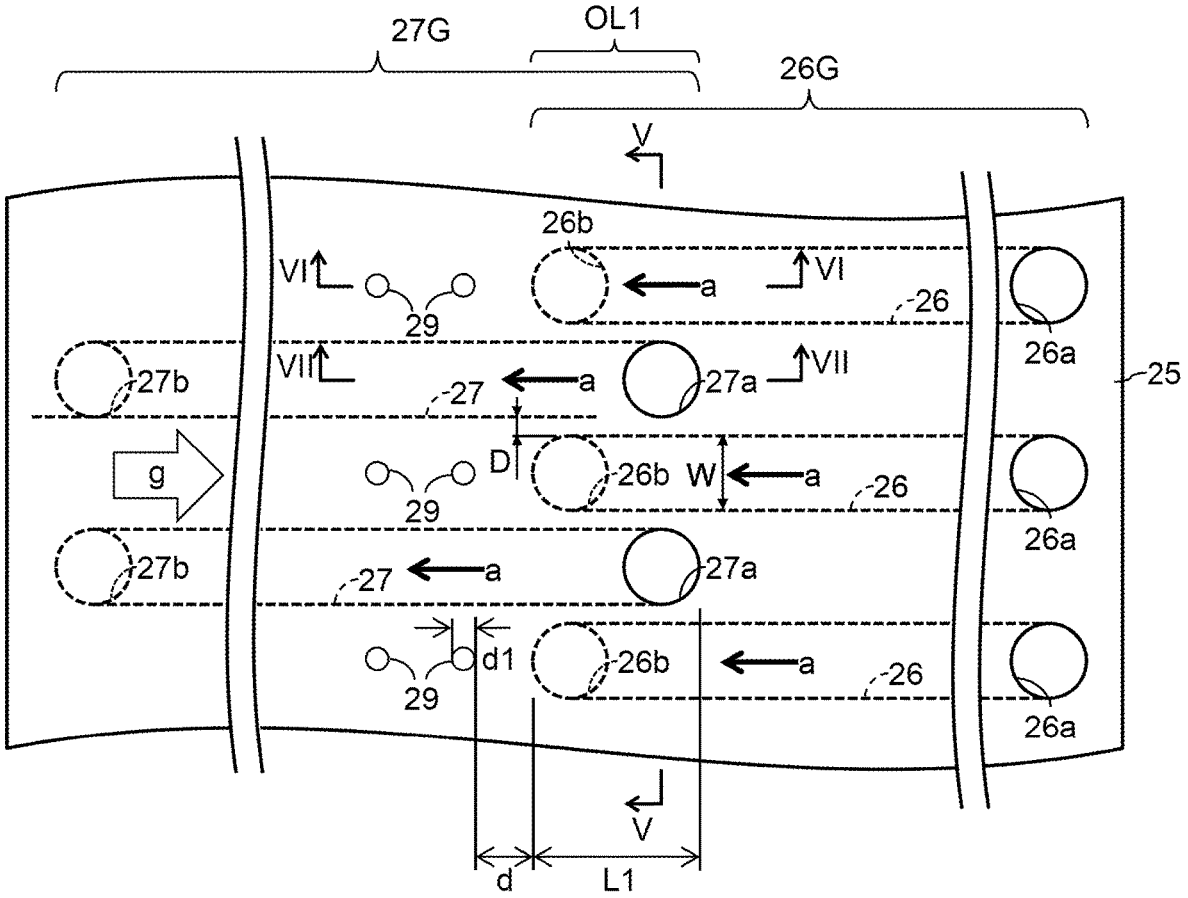
FIG. 4 is a view taken in the direction of an arrow IV in FIG. 3, the view schematically showing a part of a peripheral surface of the transition piece according to one embodiment of the present invention as viewed in the direction of the arrow IV.
Figure 5:
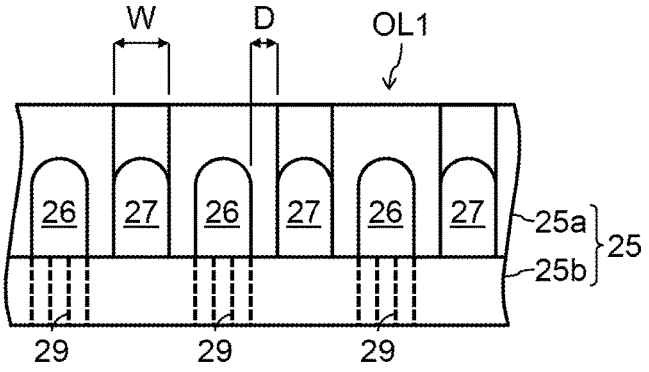
FIG. 5 is a sectional view taken in the direction of arrows along a line V-V in FIG. 4.
Figure 6:
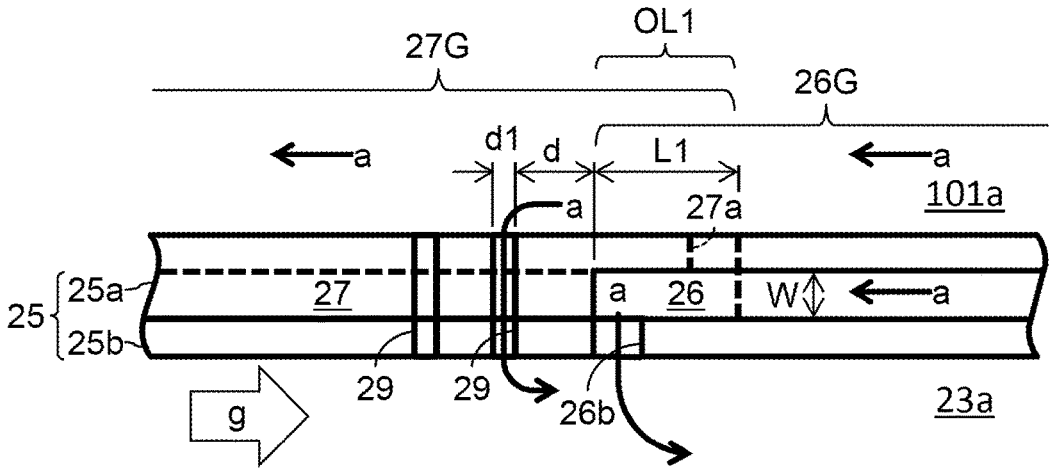
FIG. 6 is a sectional view taken in the direction of arrows along a line VI-VI in FIG. 4.
Figure 7:
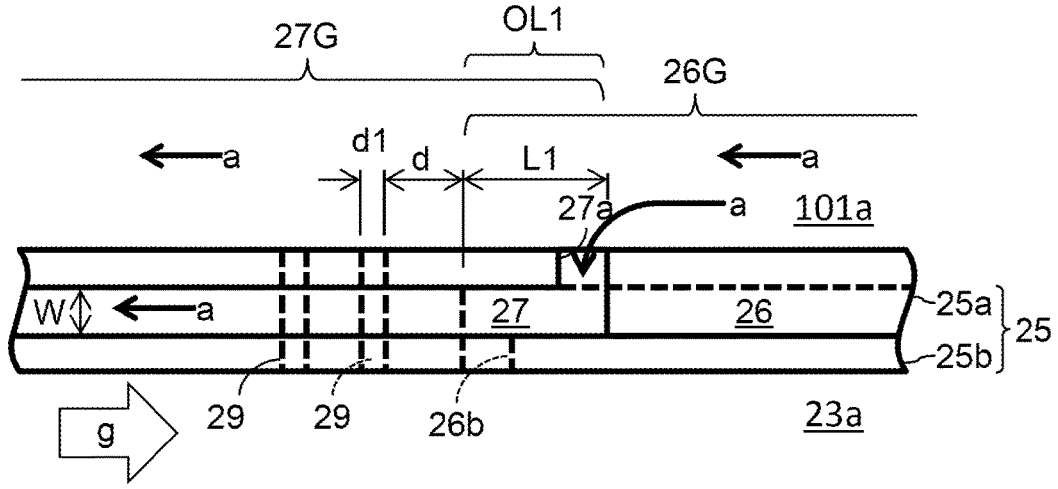
FIG. 7 is a sectional view taken in the direction of arrows along a line VII-VII in FIG. 4.
Figure 9:
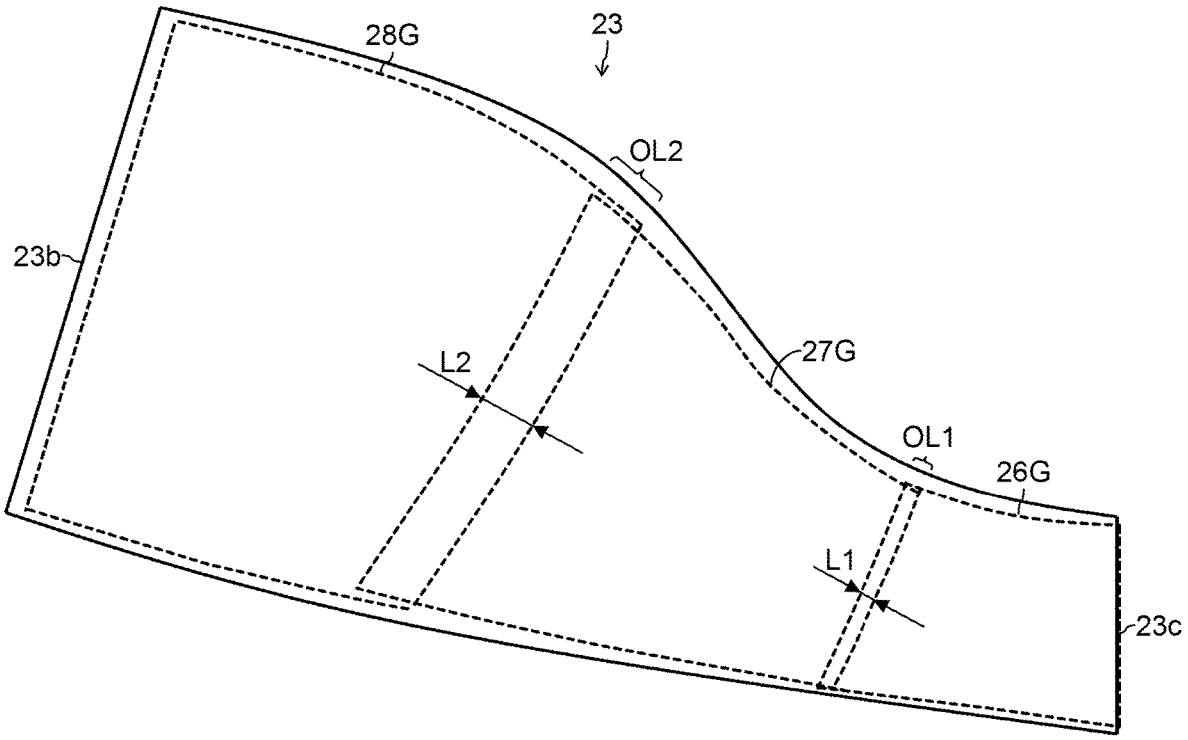
FIG. 9 is a schematic diagram showing installation regions of intra-wall flow passages in a side portion of the transition piece according to one embodiment of the present invention.
Figure 10:
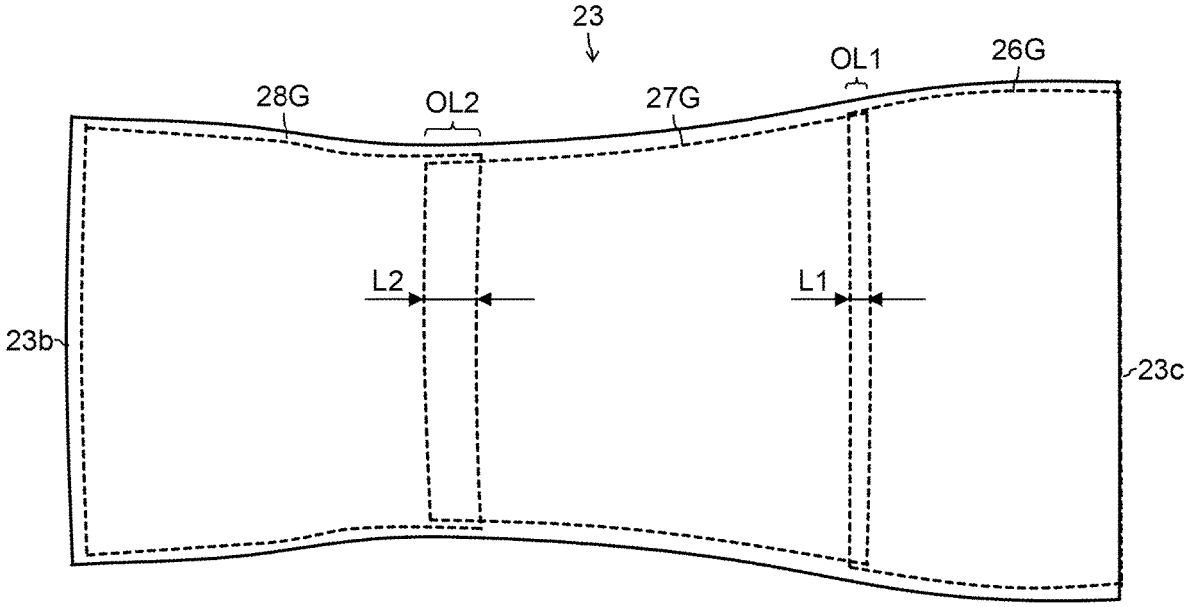
FIG. 10 is a schematic diagram showing installation regions of intra-wall flow passages in a belly side portion of the transition piece according to one embodiment of the present invention.

FIG. 4 is a view taken in the direction of an arrow IV in FIG. 3, the view schematically showing a part of a peripheral surface of the transition piece as viewed in the direction of the arrow IV. FIG. 5 is a sectional view taken in the direction of arrows along a line V-V in FIG. 4. FIG. 6 is a sectional view taken in the direction of arrows along a line VI-VI in FIG. 4. FIG. 7 is a sectional view taken in the direction of arrows along a line VII-VII in FIG. 4. FIG. 8 is a schematic diagram showing installation regions of intra-wall flow passages in a back side portion of the transition piece. FIG. 9 is a schematic diagram showing installation regions of intra-wall flow passages in a side portion of the transition piece. FIG. 10 is a schematic diagram showing installation regions of intra-wall flow passages in a belly side portion of the transition piece.

The transition piece 23 is provided with a first flow passage group 26G, a second flow passage group 27G, and a third flow passage group 28G. The first flow passage group 26G is a flow passage group formed annularly by arranging a large number of intra-wall flow passages 26 in the circumferential direction of the transition piece 23. The first flow passage group 26G makes a round of the periphery of the transition piece 23. Similarly, the second flow passage group 27G and the third flow passage group 28G are groups of large numbers of intra-wall flow passages 27 and 28. The second flow passage group 27G and the third flow passage group 28G make a round of the periphery of the transition piece 23. The first flow passage group 26G is located in a region on a downstream side of the transition piece 23 in the flow direction of the combustion gas g, that is, a side near the gas turbine 30. The second flow passage group 27G is located in a central region of the transition piece 23 in the flow direction of the combustion gas g. The second flow passage group 27G is located on a side near the combustor liner 21 with respect to the first flow passage group 26G. The third flow passage group 28G is a flow passage group located on a most upstream side in the flow direction of the combustion gas g. The third flow passage group 28G is located on a side near the combustor liner 21 with respect to the second flow passage group 27G. The intra-wall flow passages of the first flow passage group 26G, the second flow passage group 27G, and the third flow passage group 28G (the intra-wall flow passages 26 and 27 and the intra-wall flow passages 27 and 28) are not communicated to each other, but are independent of each other.

The intra-wall flow passages 26 to 28 extend within the plate 25 constituting the transition piece 23 (within a plate thickness) from a side near the gas turbine 30 to a side near the combustor liner 21, that is, along the flow direction of the combustion gas g. In the first flow passage group 26G, the intra-wall flow passages 26 adjacent to each other in the circumferential direction of the transition piece 23 have a similar length. Similarly, in the second flow passage group 27G and the third flow passage group 28G, the intra-wall flow passages 27 and 28 adjacent to each other in the circumferential direction of the transition piece 23 have a similar length.

Here, as shown in FIG. 5, the plate 25 constituting the transition piece 23 is formed by laminating an outer plate 25*a* facing the compressed air main flow passage 101*a* and an inner plate 25*b* facing the combustion gas flow passage 23*a*. The intra-wall flow passages 26 to 28 are formed as flow passages passing through the inside of the plate 25 by forming slits in the inner surface of the outer plate 25*a*, laminating the inner plate 25*b* to the inner surface of the outer plate 25*a*, and thus closing the slits. A configuration may be adopted in which the slits are provided to the inner plate 25*b*. In the present embodiment, the intra-wall flow passages 26 adjacent to each other in the circumferential direction of the transition piece 23 are not communicated to each other. However, when necessary in order to suppress flow rate deviation, for example, a configuration can also be adopted in which the intra-wall flow passages 26 adjacent to each other are communicated to each other at one position or a plurality of positions. The same is true for the intra-wall flow passages 27 and 28.

Each intra-wall flow passage 26 of the first flow passage group 26G is provided with one inlet 26*a* and one outlet 26*b* for the compressed air a (FIG. 3 and FIG. 4). The inlet 26*a* is provided to the outer plate 25*a* of the plate 25, and faces the compressed air main flow passage 101*a*. The inlet 26*a* penetrates the outer plate 25*a* in a plate thickness direction, and establishes communication between the compressed air main flow passage 101*a* and the intra-wall flow passage 26. The outlet 26*b* is provided to the inner plate 25*b* of the plate 25, and faces the combustion gas flow passage 23*a*. The outlet 26*b* penetrates the inner plate 25*b* in the plate thickness direction, and establishes communication between the combustion gas flow passage 23*a* and the intra-wall flow passage 26. During operation of the gas turbine engine 100, due to a differential pressure occurring between the inlet 26*a* and the outlet 26*b*, a part of the compressed air a flows as cooling air from the compressed air main flow passage 101*a* into each intra-wall flow passage 26, and is jetted into the combustion gas flow passage 23*a*. A part of the compressed air a thus bypasses the burner 22 (FIG. 1) and flows through the intra-wall flow passage 26, so that the transition piece 23 is cooled.

Incidentally, the inlet 26*a* is connected to an end portion on one side in the flow direction of the combustion gas g in the intra-wall flow passage 26, and the outlet 26*b* is connected to an end portion on another side in the flow direction of the combustion gas g in the intra-wall flow passage 26. Specifically, in each intra-wall flow passage 26, the inlet 26*a* is provided to the end portion on the side near the gas turbine 30, and the outlet 26*b* is provided to the end portion on the side near the combustor liner 21, so that the compressed air a flows through each intra-wall flow passage 26 in an opposite direction from the flow direction of the combustion gas g.

Each intra-wall flow passage 27 of the second flow passage group 27G has a similar configuration to that of the intra-wall flow passage 26, and is provided with one inlet 27*a* and one outlet 27*b* (FIG. 3 and FIG. 4). Each intra-wall flow passage 28 of the third flow passage group 28G is also similarly provided with one inlet 28*a* and one outlet 28*b* (FIG. 3). In the present embodiment, the arrangement of the inlets and outlets of the intra-wall flow passages 27 and 28 is similar to that of the intra-wall flow passages 26, so that the compressed air a flows through the intra-wall flow passages 27 and 28 in an opposite direction from the combustion gas g.

As shown in FIGS. 3 to 10, the installation region of the first flow passage group 26G and the installation region of the second flow passage group 27G partly overlap each other by a predetermined overlap amount L1 in the flow direction of the combustion gas g (direction of going from the combustor liner 21 to the gas turbine 30).

Specifically, one ends of the intra-wall flow passages 26 of the first flow passage group 26G are inserted between the intra-wall flow passages 27 adjacent to each other in the second flow passage group 27G, and consequently a band-shaped overlap portion OL1 is formed in which the first flow passage group 26G and the second flow passage group 27G overlap each other. This overlap portion OL1 is present so as to make a round of the transition piece 23 in the circumferential direction.

Similarly, the installation region of the second flow passage group 27G and the installation region of the third flow passage group 28G also partly overlap each other by a predetermined overlap amount L2 in the flow direction of the combustion gas g. Specifically, one ends of the intra-wall flow passages 27 of the second flow passage group 27G are inserted between the intra-wall flow passages 28 adjacent to each other in the third flow passage group 28G, and consequently a band-shaped overlap portion OL2 is formed in which the second flow passage group 27G and the third flow passage group 28G overlap each other. This overlap portion OL2 is also present so as to make a round of the transition piece 23 in the circumferential direction.

Incidentally, the intra-wall flow passages 26 to 28 are arranged densely. The present embodiment illustrates a configuration in which an interval D between two intra-wall flow passages 26 and 27 adjacent to each other in the circumferential direction of the transition piece 23 in the overlap portion OL1 is set equal to or smaller than the diameter W of the circular section of each of the intra-wall flow passages 26 and 27 (FIG. 4 and FIG. 5). Similarly, an interval D between two intra-wall flow passages 27 and 28 adjacent to each other in the circumferential direction of the transition piece 23 in the overlap portion OL2 is set equal to or smaller than the diameter W of the circular section of each of the intra-wall flow passages 27 and 28.

The above-described overlap amounts L1 and L2 are set large in a part where a shape change in the transition piece 23 is relatively large as compared with a part where the shape change in the transition piece 23 is relatively small. The shape change in the transition piece 23, which is referred to here, is, for example, the curvature of the plate 25 forming the transition piece 23, a change rate of the cross-sectional area of the transition piece 23, or a change rate of the width of the transition piece 23. The change rate of the cross-sectional area of the transition piece 23 is a rate of change in the area of a cross section of the transition piece 23, which is orthogonal to the center line of the combustion gas flow passage 23*a*, according to a change in position along the center line of the combustion gas flow passage 23*a*. The change rate of the width of the transition piece 23 is a rate of change in a dimension of the transition piece 23, which is taken in the rotational direction or radial direction of the gas turbine 30, according to a change in position along the center line of the combustion gas flow passage 23*a*. For example, the overlap amount L2 partly differs according to a position in the circumferential direction of the transition piece 23. In the present embodiment, the overlap amount L2 is large in the side portion and the belly side of the transition piece 23 as compared with the back side of the transition piece 23 (FIGS. 8 to 10). A degree of difference in the overlap amount L2 according to the position in the circumferential direction for example corresponds to a difference between shape changes in the transition piece 23 at respective positions, and is about two times in the example of FIGS. 8 to 10. The value of the overlap amount L1 can also be similarly changed according to the position in the circumferential direction. However, in the present embodiment, the overlap amount L1 is substantially fixed irrespective of the position in the circumferential direction of the transition piece 23.

In addition, in the present embodiment, as compared at a same position in the circumferential direction, the overlap amount L2 of the second flow passage group 27G and the third flow passage group 28G is partly different from the overlap amount L1 of the first flow passage group 26G and the second flow passage group 27G. Specifically, in the side portion and on the belly side of the transition piece 23, the overlap amount L2 is larger than the overlap amount L1 (FIG. 9 and FIG. 10). A degree of difference between the overlap amounts L1 and L2, for example, corresponds to a difference between shape changes in the transition piece 23 at respective positions, and is about two times in the example of FIG. 9 and FIG. 10. Also on the back side of the transition piece 23, a difference can be provided between the overlap amounts L1 and L2. In the present embodiment, however, the overlap amounts L1 and L2 are similar on the back side.

—Dilution Holes—

The plurality of dilution holes 29 described above are small holes that penetrate the plate 25 forming the transition piece 23, and establish communication between the compressed air main flow passage 101*a* and the combustion gas flow passage 23*a*. The plurality of dilution holes 29 have an aperture diameter similar to or smaller than the outlets 26*b* to 28*b* of the intra-wall flow passages 26 to 28. These dilution holes 29 are located nearer to the inlets 27*a* of the intra-wall flow passages 27 of the second flow passage group 27G than to the outlets 27*b* of the intra-wall flow passages 27 of the second flow passage group 27G in respective spaces between the intra-wall flow passages 27 adjacent to each other in the circumferential direction of the transition piece 23 in the second flow passage group 27G. Thus, the dilution holes 29 in a similar number to that of the intra-wall flow passages 26 or 27 are provided alternately with the intra-wall flow passages 27 along the overlap portion OL1, and form annular columns that make a round of the periphery of the transition piece 23.

In the present embodiment, letting dl be the diameter (hole diameter) of the dilution holes 29, a distance d between the outlet 26*b* of an intra-wall flow passage of the first flow passage group 26G and a dilution hole 29 nearest to the outlet 26*b* is set in a range of 3 to 10 times the diameter dl of the dilution hole. The distance d between the dilution hole 29 and the flow passage outlet 26*b* is preferably set within the above-described range in consideration of a possibility of affecting the strength (stress) of the transition piece when the distance d between the dilution hole 29 and the flow passage outlet 26*b* is too short and a possibility of decreasing a cooling effect of the dilution hole when the distance d is too long. In addition, the distance d between the outlet 26*b* of the intra-wall flow passage 26 and the dilution hole 29 nearest to the outlet 26*b* is equal to or smaller than the diameter W of the circular cross section of the intra-wall flow passages 26 to 28 (FIG. 4). The distance d between the outlet 26*b* and the dilution hole 29 is at least smaller than a maximum value of the overlap amount L1 of the first flow passage group 26G and the second flow passage group 27G. As an example, the distance d is about 10 mm.

In addition, a part of the transition piece 23, in which the dilution holes 29 are located, is in a position in which the shape change in the transition piece 23 is relatively large (for example, larger than an average value of shape changes in respective parts of the transition piece 23). The shape change is as described above, and means, for example, the curvature of the plate 25 forming the transition piece 23, the change rate of the cross-sectional area of the transition piece 23, or the change rate of the width of the transition piece 23. Cited as an example of a suitable position for the dilution holes 29 is a part in which such dimensional change is at a maximum or the vicinity of the part in the transition piece 23 which changes in dimension taken in the radial direction (or the rotational direction) of the gas turbine 30 with decreasing distance to the gas turbine 30.

—Operation—

During operation of the gas turbine engine 100, air is taken into and compressed by the compressor 10, and is delivered as the compressed air a at high pressure from the compressor 10 to the compressed air main flow passage 101*a* via the diffuser 11. The compressed air a delivered to the compressed air main flow passage 101*a* is supplied to the burner 22 and is jetted into the combustion chamber 21*a* together with fuel supplied from the fuel system 22*b*, and the fuel jetted together with the compressed air a is combusted (FIG. 1). The combustion gas g at high temperature, which is consequently generated in the combustion chamber 21*a*, is supplied to the gas turbine 30 via the transition piece 23. The combustion gas g drives the gas turbine 30. Then, rotating output power of the gas turbine 30 drives the load apparatus 200.

In the meantime, a part of the compressed air a going from the compressed air main flow passage 101*a* to the burner 22 bypasses the burner 22, and flows from the inlets 26*a* to 28*a* into the intra-wall flow passages 26 to 28. The compressed air a flowing into the intra-wall flow passages 26 to 28 flows in the respective intra-wall flow passages 26 to 28 and thereby cools the transition piece 23, jets into the combustion gas flow passage 23*a* on the inside of the transition piece 23, and merges with the combustion gas g. In addition, another part of the compressed air a in the compressed air main flow passage 101*a* bypasses the burner 22, and jets from the dilution holes 29 to the inside of the transition piece 23. The compressed air a jetted from the large number of dilution holes 29 as small holes flows to the gas turbine 30 while forming a film cooling film along the inner wall surface of the transition piece 23. The compressed air a thus protects the plate 25 of the transition piece 23 from the heat of the combustion gas g.

Effects (1) In the present embodiment, a large number of intra-wall flow passages 26 to 28 are provided to the transition piece 23, and the compressed air a is made to flow as cooling air in the plate 25 constituting the transition piece 23, so that the transition piece 23 through which the combustion gas g at high temperature is passed can be cooled effectively. At this time, the compressed air a is heated while flowing through the intra-wall flow passages 26 to 28. Therefore, if each intra-wall flow passage is extended from one end of the transition piece 23 to another end of the transition piece 23, the temperature of the compressed air a rises and the cooling effect is reduced in the vicinity of the outlet of each intra-wall flow passage because each intra-wall flow passage is lengthened.

Accordingly, in the present embodiment, a length per intra-wall flow passage is reduced by dividing the transition piece 23 into a plurality of regions in the flow direction of the combustion gas g, and forming flow passage groups independent of each other in the respective regions. The temperature of the compressed air a in the vicinities of the outlets of the respective intra-wall flow passages 26 to 28 is thereby lowered, so that the cooling effect on the transition piece 23 can be improved.

In addition, when the supply amount of the compressed air a to the burner 22 becomes excessive under an operation condition of a small amount of fuel supply, there is a fear of decreasing combustion temperature and impairing combustion stability. On the other hand, the present embodiment can improve the combustion stability by supplying a part of the compressed air a to a region in which combustion reaction in the combustion gas flow passage 23*a* is completed on the inside of the transition piece 23 while bypassing the burner 22 via the dilution holes 29 of a small diameter, which are provided in large numbers.

However, the transition piece 23 is in a thermally harsh environment because the combustion gas g at high temperature whose combustion reaction is progressed in the combustion chamber 21*a* is passed through the transition piece 23. Furthermore, also in terms of the shape of the transition piece 23, stress tends to increase because the transition piece 23 is changed in shape from a circular cross section to a rectangular cross section. When the dilution holes 29 are provided to the transition pieces 23, stress can concentrate on the periphery of the dilution holes 29.

On the other hand, in the present embodiment, the dilution holes 29 are arranged nearer to the inlets 27*a* of the intra-wall flow passages 27 of the second flow passage group 27G than the outlets 27*b* of the intra-wall flow passages 27 of the second flow passage group 27G in the respective spaces between the intra-wall flow passages 27 adjacent to each other in the circumferential direction in the second flow passage group 27G. The plate 25 in the vicinities of the inlets 27*a* of the intra-wall flow passages 27 is cooled by the compressed air a at relatively low temperature soon after flowing into the intra-wall flow passages 27, and therefore has a low metal temperature and a low stress. By installing the dilution holes 29 at this position, it is possible to suppress stress concentration in the vicinities of the dilution holes 29, and thus suppress a risk in terms of strength, which is attendant on the installation of the dilution holes 29. In addition, the compressed air a flowing through the dilution holes 29 can contribute to the cooling of the transition piece 23.

(2) If the number of dilution holes 29 is reduced, and the aperture area thereof is correspondingly increased, the dilution holes 29 interfere with the intra-wall flow passages 27. In the present embodiment, however, the dilution holes 29 are divided into a number similar to that of the intra-wall flow passages 27 present in a large number, and the aperture area of each dilution hole 29 is reduced. The interference between the dilution holes 29 and the intra-wall flow passages 27 can be thereby avoided, so that the intended cooling effect of the intra-wall flow passages 27 is not impaired. In addition, because annular columns are formed by the large number of dilution holes 29 having a small diameter, a film cooling film (cooling air layer) that covers the inner wall of the transition piece 23 can be formed. The compressed air a passed through the dilution holes 29 for a purpose of improving the combustion stability by bypassing the burner 22 can be used also for film cooling, and thereby serve also to protect the transition piece 23 from the heat of the combustion gas g.

(3) From a viewpoint of preventing a part of the compressed air a, which is made to bypass the burner 22 and merge with the combustion gas g, from affecting the combustion reaction of the flame, it is advantageous for the position of the dilution holes 29 to be near the gas turbine 30. However, when a distance between the gas turbine 30 and the dilution holes 29 is too short, the compressed air a having a large temperature difference from the combustion gas g is not sufficiently mixed with the combustion gas g, and the combustion gas g flows into the gas turbine 30 in a state in which a temperature distribution is not uniform. The stress of the gas turbine 30 can therefore be increased.

On the other hand, in the present embodiment, as for the compressed air a jetted from the dilution holes 29 installed at intervals of the intra-wall flow passages 27, a distance for mixing with the combustion gas g is secured by the length of the first flow passage group 26G before the compressed air a is supplied to the gas turbine 30. Hence, the compressed air a jetted from the dilution holes 29 to the combustion gas flow passage 23*a* can be sufficiently mixed with the combustion gas g, and an increase in the stress of the gas turbine 30 can be suppressed by uniformizing the temperature distribution of the combustion gas g.

(4) There is a temperature difference between the compressed air a jetted from the outlets 26*b* of the intra-wall flow passages 26 of the first flow passage group 26G and the compressed air a flowing into the inlets 27*a* of the intra-wall flow passages 27 of the second flow passage group 27G. Thus, when the outlets 26*b* and the inlets 27*a* are too close to each other, stress in the vicinities thereof can be increased. Accordingly, the increase in the stress in the vicinities thereof can be suppressed by making the installation region of the first flow passage group 26G and the installation region of the second flow passage group 27G partly overlap each other, and securing intervals between the outlets 26*b* and the inlets 27*a*. The same is true for the overlap structure of the second flow passage group 27G and the third flow passage group 28G. In particular, a further effect can be obtained by setting the overlap amounts L1 and L2 large at positions where the shape change in the transition piece 23 is relatively large.

Modifications

Description has been made by taking as an example a configuration in which the annular columns of the dilution holes 29 are provided along the overlap portion OL1. However, in place of this or in addition to this, a configuration may be adopted in which annular columns of dilution holes 29 are provided along the overlap portion OL2.

A configuration has been illustrated in which difference is provided to the overlap amount L2 according to the magnitude of the shape change in the transition piece 23. However, such adjustment of the overlap amount is not necessarily needed insofar as the above-described essential effect (1) is obtained.

In addition, in the present embodiment, a configuration has been illustrated in which three flow passage groups, that is, the first to third flow passage groups 26G to 28G are provided to the transition piece 23. However, a configuration may be adopted in which the transition piece 23 is divided into two regions, and two flow passage groups are provided. A configuration may also be adopted in which the transition piece 23 is divided into four regions or more, and four flow passage groups or more are provided.

A configuration may be adopted in which the respective inlets or outlets of the intra-wall flow passages 26 to 28 are shared between intra-wall flow passages adjacent to each other. That is, a configuration may be adopted in which one inlet or outlet communicates with a plurality of intra-wall flow passages with the inlet or outlet enlarged or made to be an elongated hole long in the circumferential direction.

Description has been made of an example in which the intra-wall flow passages 26 to 28 are formed by laminating the outer plate 25*a* provided with the slits to the inner plate 25*b* of the plate 25. However, the method of forming the intra-wall flow passages 26 to 28 can be changed as appropriate.

DESCRIPTION OF REFERENCE CHARACTERS

10: Compressor
20: Combustor
21: Combustor liner
23: Transition piece
23*a*: Combustion gas flow passage
25: Plate
26 to 28: Intra-wall flow passage
26*a*, 27*a*, 28*a*: Inlet
26*b*, 27*b*, 28*b*: Outlet
26G: First flow passage group
27G: Second flow passage group
29: Dilution hole
30: Gas turbine
100: Gas turbine engine
101*a*: Compressed air main flow passage
a: Compressed air
d: Distance between the outlet of intra-wall flow passage and a dilution hole
D: Interval between intra-wall flow passages
g: Combustion gas
OL1, OL2: Overlap portion
W: Diameter of intra-wall flow passage

What is claimed is:

1. An assembly for a combustor of a gas turbine engine, the assembly comprising a transition piece being formed in a tubular shape by a plate and separating a compressed air main flow passage from a combustion gas flow passage defined within the transition piece, the compressed air main flow passage configured to supply compressed air from a compressor of the gas turbine engine to the combustor of the gas turbine engine, the transition piece configured to supply a combustion gas from a combustor liner to a gas turbine of the gas turbine engine, the transition piece comprising:

a first flow passage group formed by arranging a plurality of intra-wall flow passages in a circumferential direction of the transition piece, the intra-wall flow passages of the first flow passage group extending within the plate from a gas turbine side of the transition piece to a combustor liner side of the transition piece;

a second flow passage group located closer to the combustor liner side than the first flow passage group and formed by arranging a plurality of intra-wall flow passages in the circumferential direction of the transition piece, the intra-wall flow passages of the second flow passage group extending within the plate from the gas turbine side to the combustor liner side; and a plurality of dilution holes that penetrate the plate and establish communication between the compressed air main flow passage and the combustion gas flow passage, wherein each of the intra-wall flow passages of the first flow passage group and the second flow passage group has an inlet facing the compressed air main flow passage at an end portion of the respective intra-wall flow passage on the gas turbine side, and has an outlet facing the combustion gas flow passage at an end portion of the respective intra-wall flow passage on the combustor liner side, the plurality of dilution holes are located nearer to the inlets of the intra-wall flow passage of the second flow passage group than to the outlets of the intra-wall flow passage of the second flow passage group and a respective dilution hole of the plurality of dilution holes is located in each space defined between adjacent intra-wall flow passages in the second flow passage group, wherein the plurality of dilution holes extend through the entire thickness of the transition piece, each dilution hole having an inlet opening defining a first center axis and positioned on a side of the plate bounding the compressed air main flow passage and an outlet opening defining a second center axis and positioned on a side of the plate bounding the combustion gas flow passage, the first center axis being coaxial with the second center axis.

2. The assembly according to claim 1, wherein the transition piece has an overlap portion in which an installation region of the first flow passage group and an installation region of the second flow passage group partly overlap each other in a flow direction of the combustion gas.

3. The assembly according to claim 1, wherein a distance between the outlet of an intra-wall flow passage of the plurality of intra-wall flow passages of the first flow passage group and a nearest dilution hole of the plurality of dilution holes is in a range of 3 to 10 times a hole diameter of the dilution hole.

4. The assembly according to claim 1, wherein an interval between two intra-wall flow passages adjacent to each other in the circumferential direction of the transition piece is equal to or smaller than a diameter of each of the intra-wall flow passages of the first flow passage group and the second flow passage group.

5. A combustor comprising the assembly according to claim 1.

6. A gas turbine engine comprising:

a compressor that generates a compressed air by compressing air;

the combustor according to claim 5 that generates a combustion gas by combusting fuel together with the compressed air delivered from the compressor; and a gas turbine that is driven by the combustion gas supplied from the combustor.

* * * * *